US008899807B2

(12) United States Patent
Yamamura

(10) Patent No.: US 8,899,807 B2
(45) Date of Patent: Dec. 2, 2014

(54) VEHICULAR HEADLAMP

(71) Applicant: Satoshi Yamamura, Shizuoka (JP)

(72) Inventor: Satoshi Yamamura, Shizuoka (JP)

(73) Assignee: Koito Manufacturing Co., Ltd, Tokyo (JP)

( * ) Notice: Subject to any disclaimer, the term of this patent is extended or adjusted under 35 U.S.C. 154(b) by 56 days.

(21) Appl. No.: 13/891,903

(22) Filed: May 10, 2013

(65) Prior Publication Data

US 2013/0314936 A1 Nov. 28, 2013

(30) Foreign Application Priority Data

May 22, 2012 (JP) ..... 2012-116579

(51) Int. Cl.
*F21S 8/10* (2006.01)

(52) U.S. Cl.
CPC ..... *F21S 48/1317* (2013.01); *F21S 48/1159* (2013.01); *F21S 48/1747* (2013.01); *F21S 48/1104* (2013.01); *F21S 48/1323* (2013.01)
USPC ..... 362/545; 362/507

(58) Field of Classification Search
USPC ..... 362/545.544, 507
See application file for complete search history.

(56) References Cited

U.S. PATENT DOCUMENTS

| | | | | |
|---|---|---|---|---|
| 7,410,282 | B2 * | 8/2008 | Eichelberger et al. | 362/545 |
| 7,553,054 | B2 * | 6/2009 | Yagi | 362/545 |
| 7,901,122 | B2 * | 3/2011 | Komatsu | 362/523 |
| 8,292,479 | B2 * | 10/2012 | Sazuka et al. | 362/511 |
| 2004/0213014 | A1 * | 10/2004 | Koike | 362/545 |
| 2008/0204888 | A1 * | 8/2008 | Kan et al. | 359/629 |
| 2009/0161371 | A1 * | 6/2009 | Vukosic et al. | 362/373 |

FOREIGN PATENT DOCUMENTS

JP 2010-211947 A 9/2010

* cited by examiner

*Primary Examiner* — Laura Tso
(74) *Attorney, Agent, or Firm* — Sughrue Mion, PLLC

(57) ABSTRACT

A vehicular headlamp includes: a plurality of semiconductor light emitting element chips; and a reflector that has a reflection surface with a paraboloid shape, and that reflects, by the reflection surface, light from the semiconductor light emitting element chips so as to send the light in a headlamp beam direction of the vehicular headlamp, wherein the plurality of semiconductor light emitting element chips are arranged along a plane perpendicular to the headlamp beam direction, and a focal point of the reflection surface of the reflector is disposed in or near an area between the semiconductor light emitting element chips that are next to each other.

10 Claims, 5 Drawing Sheets

VEHICULAR HEADLAMP

INCORPORATION BY REFERENCE

The disclosure of Japanese Patent Application No. 2012-116579 filed on May 22, 2012 including the specification, drawings and abstract is incorporated herein by reference in its entirety.

BACKGROUND OF THE INVENTION

1. Field of the Invention

The invention relates to a vehicular headlamp that uses semiconductor light emitting elements, such as light emitting diodes (LEDs) or the like, as a light source.

2. Description of Related Art

In recent years, there have been proposed various vehicular headlamps that use semiconductor light emitting elements as a light source. Generally, such a vehicular headlamp employs light emitting diodes (LEDs) as semiconductor light emitting elements. For example, a vehicular headlamp in which a plurality of LEDs that form an array emits light directly to a projection lens (hereinafter, also referred to as direct emission headlamp) has been proposed (see Japanese Patent Application Publication No. 2010-211947 (JP 2010-211947 A)).

However, in the construction of a direct emission headlamp as described in JP 2010-211947 A, light that does not enter the projection lens (leaking light) exists as well, so that it is not easy to improve the utilization efficiency of light emitted from the LEDs. Furthermore, there is a demand for clear display of cut-off lines in a light distribution pattern which are generally formed on or near a preceding vehicle.

SUMMARY OF THE INVENTION

The invention provides a vehicular headlamp capable of clearly forming cut-off lines in light distribution patterns while improving the utilization efficiency of the light emitted from semiconductor light emitting elements.

A vehicular headlamp in accordance with one aspect of the invention includes: a plurality of semiconductor light emitting element chips; and a reflector that has a reflection surface with a paraboloid shape, and that reflects, by the reflection surface, light from the semiconductor light emitting element chips so as to send the light in a headlamp beam direction of the vehicular headlamp, wherein: the plurality of semiconductor light emitting element chips are arranged along a plane perpendicular to the headlamp beam direction; and a focal point of the reflection surface of the reflector is disposed in or near an area between the semiconductor light emitting element chips that are next to each other.

According to the vehicular headlamp of the invention, since light emitted from the vicinity of the focal point converges, a cut-off line that is clear and is high in luminance can be formed at an end portion of an illuminated area formed by light emitted from the semiconductor light emitting element chips adjacent to the focal point. Furthermore, when the light from the light source is entirely reflected forward by the reflector without using a projection lens, it also becomes possible to improve the light utilization efficiency.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
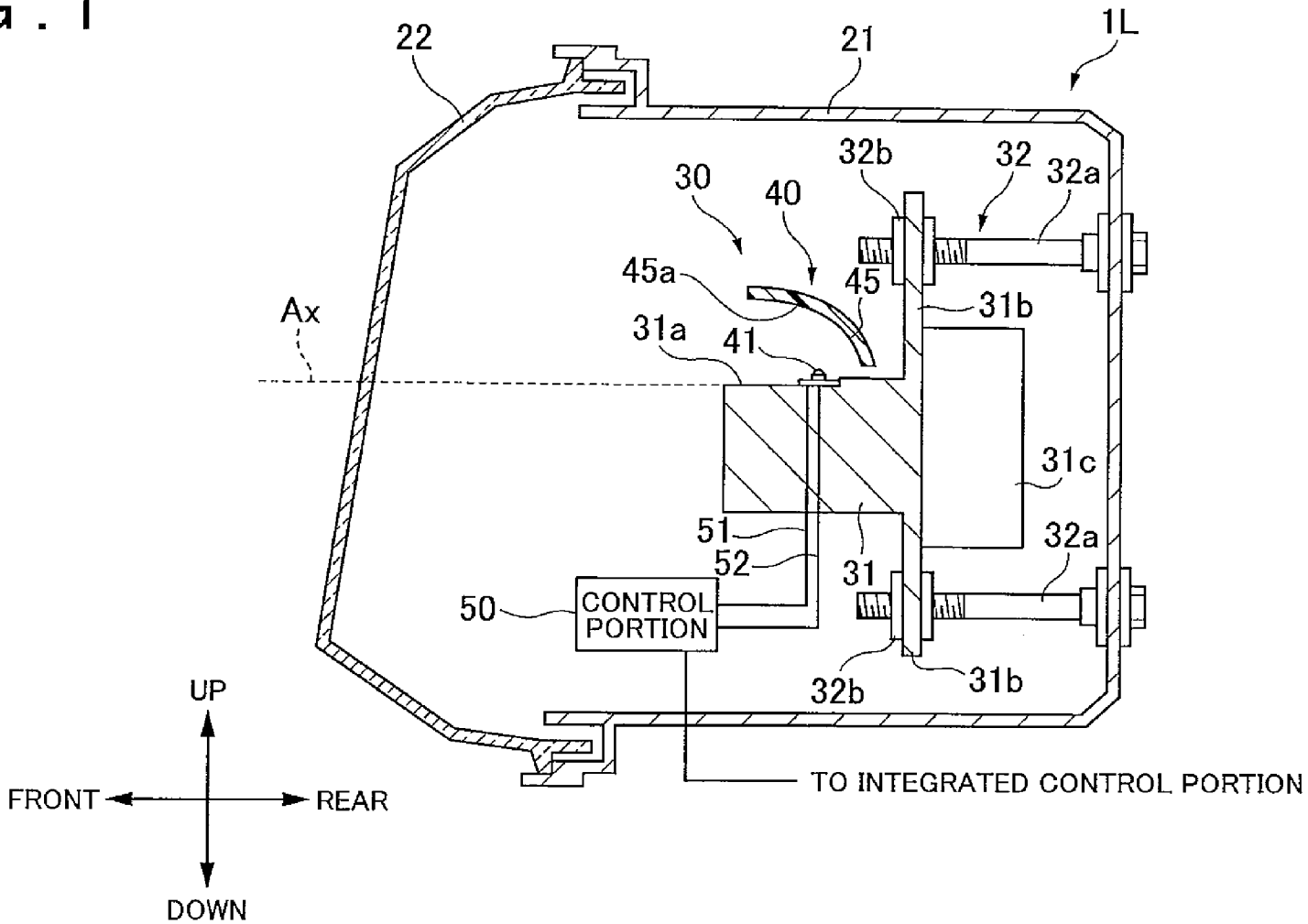
FIG. 1 is a sectional view showing a construction of a vehicular headlamp in accordance with an embodiment of the invention.

An embodiment of the invention will be described in detail hereinafter with reference to the accompanying drawings. Note that, in the drawings, scales are appropriately varied so that each member shown has a recognizable size.

FIG. 1 is a vertical sectional view showing a construction of a vehicular headlamp in accordance with the embodiment of the invention, and shows a structure of the vehicular headlamp that is seen from the left side of the vertical sectional plane. A vehicular headlamp 1L attached to a left-side portion of a front of a vehicle in the embodiment has an optical axis Ax that extends in the longitudinal direction of the vehicle as shown in FIG. 1, and includes a lamp body 21, an outer cover 22 and a lamp unit 30. Incidentally, a vehicular headlamp 1R attached to a right-side portion of the front of the vehicle has a construction basically similar to the vehicular headlamp 1L. Hereinafter, the vehicular headlamp 1L will mainly be described, and redundant description of the constructions of the vehicular headlamp 1R that are substantially the same as those of the vehicle lamp 1L is omitted.

The vehicular headlamp 1L includes the lamp body 21 whose front portion has an opening and the outer cover 22 that is a plain transparent cover. The outer cover 22 is attached to the lamp body 21 to close the opening of the lamp body 21. The lamp body 21 and the outer cover 22 form a tightly closed lamp chamber.

A lamp unit 30 housed in the lamp chamber has a holder 31, a posture adjustment mechanism 32, a light source unit 40, and a control portion 50. Furthermore, the lamp unit 30 is what is called a parabola type lamp unit, and projects light from the light source unit 40 forward relative to the vehicle.

The holder 31 is formed of a block-shaped member made of metal, which is highly heat conductive, for example. The light source unit 40 is fixed to and supported on an upper surface 31*a* of the holder 31. A rear end portion of the holder 31 is provided with a flange 31*b*. Heat dissipating fins 31*c* are provided on the back of the flange 31*b*. The heat dissipating fins 31*c* are suitably shaped and arranged so as to efficiently dissipate heat produced from the light source unit 40.

The lamp unit 30 is fixedly disposed relative to the lamp body 21 via the posture adjustment mechanism 32. The posture adjustment mechanism 32 has a plurality of bolt members 32*a* and a plurality of nut members 32*b*. A rear end portion of each bolt member 32*a* is screwed and fixed to the lamp body 21. Furthermore, a front end portion of each bolt member 32*a* is screwed and joined to a corresponding one of the nut members 32*b*. Via the nut members 32*b*, the front end portions of the bolt members 32*a* are fixedly disposed relative to the flange 31*b* of the holder 31. Due to this construction, the orientation of the lamp unit 30 in the lamp chamber can be adjusted by appropriately adjusting the screwed positions of the nut members 32*b* on the corresponding bolt members 32*b* disposed at a plurality of locations in the posture adjustment mechanism 32.

The control portion 50 is electrically connected to semiconductor light emitting element chips 43 (described later) of the light source unit 40 via an electric power line 51, a control line 52, etc. so as to be able to communicate with the semiconductor light emitting element chips 43. Furthermore, the control portion 50 is also electrically connected to an integrated control portion of the vehicle so that they can communicate with each other. The integrated control portion has a central processing unit (CPU) that executes various control programs, a read only memory (ROM) that stores the programs, a random access memory (RAM) that is used as a work area for data storage and execution of the programs, etc., and executes various controls of the vehicle. That is, the control portion 50 functions as at least part of control means in the invention, and the part of the control means includes a combination of hardware, that is, elements represented by a processor and a memory of a computer, mechanical devices, electric circuits, etc., and software such as computer programs and the like.

The light source unit 40 has, on the optical axis Ax, the light source 41 that is disposed facing upward, and the reflector 45 that is disposed above the light source 41 so as to reflect light emitted from the light source 41 and send the light forward relative to the vehicle.

The reflector 45 has a reflection surface 45*a* that has a paraboloid shape. The light emitted from the light source 41 is reflected by the reflection surface 45*a* of the reflector 45 and is thereby sent forward relative to the vehicle. An inner surface of the reflection surface 45*a* of the reflector 45 is provided with a coating of or a vapor deposit of, for example, a material that is capable of reflecting incident light at high efficiency.

Figure 2:
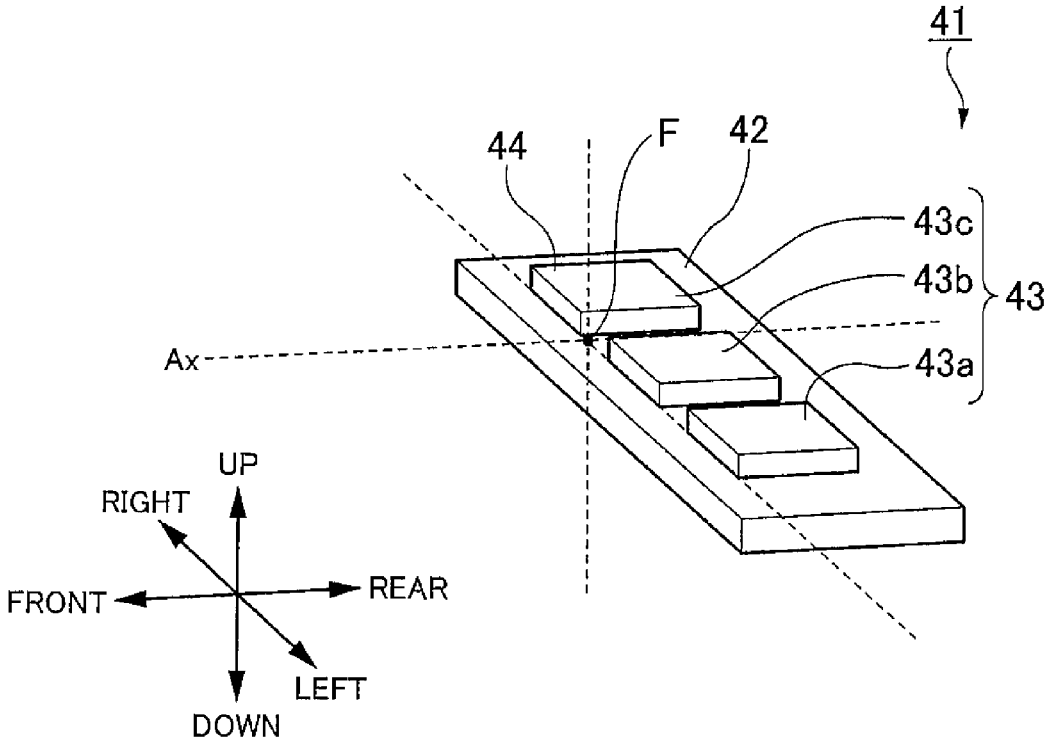
FIG. 2 is an enlarged perspective view illustrating a construction of a light source shown in FIG. 1.

FIG. 2 is an enlarged perspective view illustrating a construction of the light source 41. The light source 41, as shown in FIG. 2, has a substrate 42 and a plurality of (three in this embodiment) semiconductor light emitting element chips 43 disposed on the substrate 42. These semiconductor light emitting element chips 43 are each constructed of a white light emitting diode (LED). The semiconductor light emitting element chips 43 are arranged along the lateral direction of the vehicle. More concretely, the chips 43 are disposed on the substrate 42 adjacent to each other in a row with small intervals left therebetween in the horizontal direction perpendicular to the optical axis Ax. Each of the semiconductor light emitting element chips 43 has a light emitting surface 44 that has a square shape with 1 mm side length (a quadrilateral shape). The light source 41 is fixed to and supported on the holder 31 so that the light emitting surface 44 of each of the semiconductor light emitting element chips 43 faces vertically upward.

The semiconductor light emitting element chips 43 juxtaposed in a row in the lateral direction of the vehicle are named, in order from the left side, a first semiconductor light emitting element chip 43*a*, a second semiconductor light emitting element chip 43*b*, and a third semiconductor light emitting element chip 43*c*. The focal point F of the reflection surface 45*a* of the reflector 45 is positioned in an area between the second semiconductor light emitting element chip 43*b* and the third semiconductor light emitting element chip 43*c* or in the vicinity of the area. In this invention, the range in which the focal point F is positioned needs to be within the aforementioned area (between the second semiconductor light emitting element chip 43*b* and the third semiconductor light emitting element chip 43*c*) or be so close to the area that the semiconductor light emitting element chips' edges that are adjacent to the aforementioned area and that lie in the vehicle longitudinal direction are projected as recognizable images in the light distribution pattern formed by light from the headlamp. Preferably, the focal point F of the reflection surface 45*a* of the reflector 45 is positioned between the second semiconductor light emitting element chip 43*b* and the third semiconductor light emitting element chip 43*c*.

Therefore, in the entire illuminated area formed by the second semiconductor light omitting element chip 43*b*, the light emitted from the vicinity of the one of the sides of the chip 43*b* which is adjacent to the focal point F converges, so that one of end portions of the illuminated area formed by the second semiconductor light emitting element chip 43*b* form a cut-off line that is clear and that is high in luminance. The same applies to the second semiconductor light emitting element chip 43*c*. Furthermore, the light emitting surfaces 44 of the second and third semiconductor light emitting element chips 43*b* and 43*c* are disposed so that, of the four sides of each quadrilateral light emitting surface 44, the side nearest to the focal point F of the reflection surface 45*a* of the reflector 45 lies along the longitudinal direction of the vehicle.

The semiconductor light emitting element chips 43 form an electric current circuit together with the control portion 50 via the electric power line 51 and the control line 52 as described above. Therefore, the control portion 50 realizes a plurality of lighting modes of the semiconductor light emitting element chips 43 by turning on and off the first, second, and third semiconductor light emitting element chips 43*a*, 43*b*, and 43*c* by switching between the supply of current and the shut-off of the current to each semiconductor light emitting element chip 43 individually of each other, via the electric power line 51 and the control line 52.

FIGS. 3A to 3G are schematic diagrams showing light distribution patterns that are formed according to the lighting modes of the semiconductor light emitting element chips 43. In this embodiment, each of the two vehicular headlamps is capable of realizing seven light distribution patterns as shown in FIGS. 3A to 3G. FIGS. 3A to 3G show the light distribution patterns projected on an imaginary vertical screen disposed at 25 meters in front of the vehicular headlamp 1L. Furthermore, an H-V area is set on the imaginary vertical screen in order to describe the light distribution patterns. The H axis lies along the horizontal direction (vehicle lateral direction), and the V axis lies along a direction perpendicular to the H axis (in the vehicle up-down direction).

In FIGS. 3A to 3G, a character sequence "PA1" denotes an illuminated area that is illuminated by the first semiconductor light emitting element chip 43*a*, and a character sequence "HS1" denotes an imaginary smallest image of the first semiconductor light emitting element chip 43*a* in the illuminated area PA1, and a character sequence "HM1" denotes an imaginary largest image thereof in the illuminated area PA1 Furthermore, a character sequence "PA2" denotes an illuminated area that is illuminated by the second semiconductor light emitting element chip 43*b*, a character sequence "HS2" denotes an imaginary smallest image of the second semiconductor light emitting element chip 43*b* in the illuminated area PA2, and a character sequence "HM2" denotes an imaginary largest image thereof in the illuminated area PA2. Furthermore, a character sequence "PA3" denotes an illuminated area that is illuminated by the third semiconductor light emitting element chip 43*c*, a character sequence "HS3" denotes an imaginary smallest image of the third semiconductor light emitting element chip 43*c* in the illuminated area PA3, and a character sequence "HM3" denotes an imaginary largest image thereof in the illuminated area PA3. Furthermore, a character sequence "HCA" in FIG. 3C etc. denotes an area that is clear and is high in luminance due to convergence of light from the vicinity of the focal point (hereinafter, also referred to as the clear area).

Figure 3A:
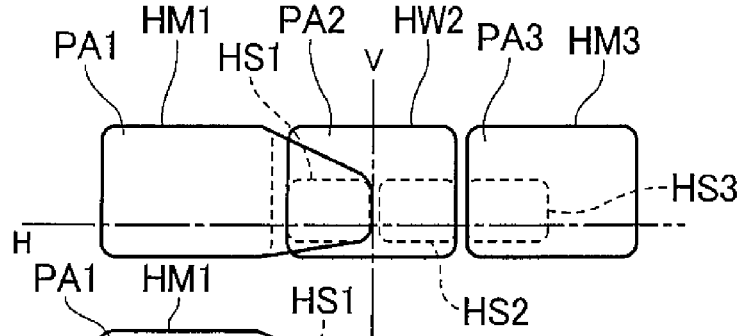
FIGS. 3A to 3G are schematic diagrams showing light distribution patterns that are formed according to a plurality of lighting modes of semiconductor light emitting element chips shown in FIG. 2.

FIG. 3A shows a light distribution pattern that is formed by a first lighting mode in which all of the first, second, and third semiconductor light emitting element chips 43*a*, 43*b*, and 43*c* are turned on. In this light distribution pattern, the entire H-V area is illuminated with high-beam light. Note that the first semiconductor light emitting element chip 43*a* is not disposed adjacent to the focal point F of the reflection surface 45*a* of the reflector 45. Therefore, in the illuminated area PA1, the imaginary largest image HM1 and the imaginary smallest image HS1 do not overlap with each other, but are next to each other. Incidentally, in the illuminated area PA1, individual images from the imaginary smallest image HS1 to the imaginary largest image HM1 are continually formed so that focal point F-side end portions of the images are not superimposed on each other. Therefore, as a whole, the illuminated area PA1 is formed in a generally trapezoidal shape that extends in the lateral direction.

Furthermore, since the second semiconductor light emitting element chip 43*b* is disposed so that the right side thereof is adjacent to the focal point F, the illuminated area PA2 is formed so that in the illuminated area PA2, images from the imaginary smallest image HS2 to the imaginary largest image HM2 are formed, with right end portions of the images superimposed on each other. Likewise, since the third semiconductor light emitting element chip 43*c* is disposed so that the left side thereof is adjacent to the focal point F, the illuminated area PA3 is formed so that in the illuminated area PA3, images from the imaginary smallest image HS3 to the imaginary largest image HM3 are formed, with left end portions of the images superimposed on each other. In the light distribution pattern shown in FIG. 3A, for which all the three semiconductor light emitting elements chips 43 are turned on, the illuminated area PA1 and the illuminated area PA2 partially overlap with each other.

In this embodiment, the dimensions of the imaginary largest images HM1, HM2 and HM3 are set so as to be at most twice the dimensions of the imaginary smallest images HS1, HS2 and HS3, respectively. Therefore, the adjacent ones of the imaginary largest images HM1, HM2 and HM3 are prevented from overlapping with each other, so that occurrence of irregular luminance can be prevented.

Figure 3B:
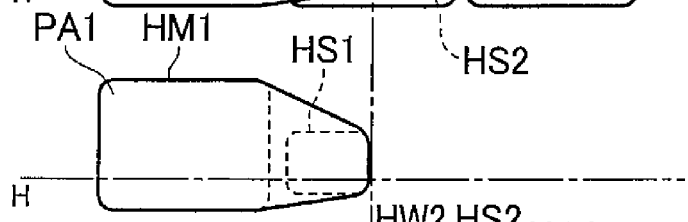

FIG. 3B shows a light distribution pattern formed by a second lighting mode in which only the first semiconductor light emitting element chip 43*a* is turned on. In this light distribution pattern, a left-side area in the H-V area is illuminated with high-beam light. Since the first semiconductor light emitting element chip 43*a* is disposed remote from the focal point F of the reflection surface 45*a* of the reflector 45, a clear area HCA is not formed in the illuminated area PA1.

Figure 3C:
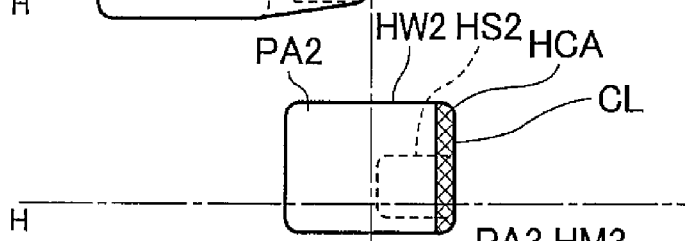

FIG. 3C shows a light distribution pattern formed by a third lighting mode in which only the second semiconductor light emitting element chip 43*b* is turned on. In this light distribution pattern, a central area in the H-V area is illuminated with high-beam light. The second semiconductor light emitting element chip 43*b* is disposed so that the right side thereof is adjacent to the focal point F. Thus, the clear area HCA at the right edge of the illuminated area PA2 forms a boundary with a non-illuminated area and therefore forms a cut-off line CL.

Figure 3D:
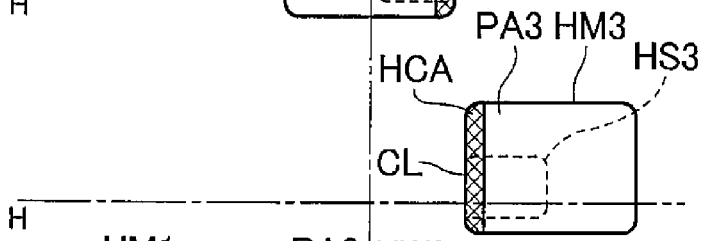

FIG. 3D shows a light distribution pattern formed by a fourth lighting mode in which only the third semiconductor light emitting element chip 43*c* is turned on. In this light distribution pattern, a right-side area in the H-V area is illuminated with high-beam light. The third semiconductor light emitting element chip 43*c* is disposed so that the left side thereof is adjacent to the focal point F. Thus, a clear area HCA at the left edge of the illuminated area PA3 forms a boundary with a non-illuminated area and therefore forms a cut-off line CL.

Figure 3E:
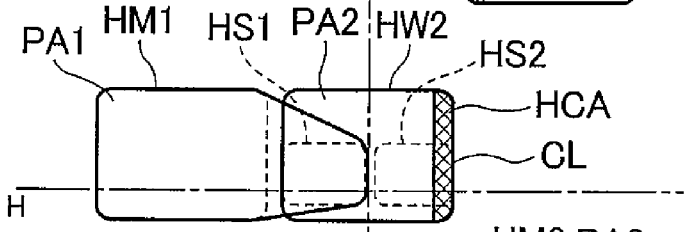

FIG. 3E shows a light distribution pattern formed by a fifth lighting mode in which the first and second semiconductor light emitting element chips 43*a* and 43*b* are turned on. In this light distribution pattern, the left-side area and the central area in the H-V area are illuminated with high-beam light. Since the first semiconductor light emitting element chip 43*a* is disposed remote from the focal point F of the reflection surface 45*a* of the reflector 45, a clear area HCA is not formed in the illuminated area PA1 that is illuminated by the first semiconductor light emitting element chip 43*a*. On the other hand, the second semiconductor light emitting element chip 43*b* is disposed so that the right side thereof is adjacent to the focal point F. Thus, the clear area HCA at the right edge of the illuminated area PA2 forms a boundary with a non-illuminated area and therefore forms a cut-off line CL.

Figure 3F:
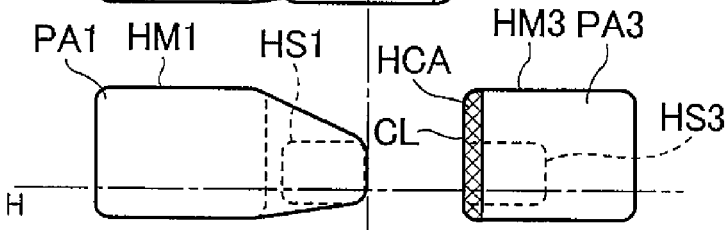

FIG. 3F shows a light distribution pattern formed by a sixth lighting mode in which the first and third semiconductor light emitting element chips 43*a* and 43*c* are turned on. In this light distribution pattern, the left-side area and the right-side area in the H-V area are illuminated with high-beam light. Since the first semiconductor light emitting element chip 43*a* is disposed remote from the focal point F of the reflection surface 45*a* of the reflector 45, the illuminated area PA1 illuminated by the first semiconductor light emitting element chip 43*a* does not have a clear area HCA. On the other hand, the third semiconductor light emitting element chip 43*c* is disposed so that the left side thereof is adjacent to the focal point F. Thus, the clear area HCA at the left edge of the illuminated area PA3 forms a boundary with a non-illuminated area and forms a cut-off line CL.

Figure 3G:
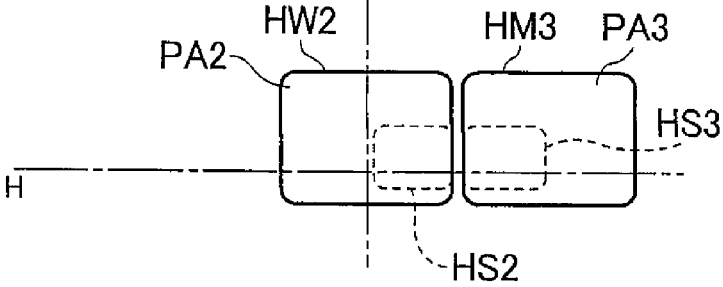

FIG. 3G shows a light distribution pattern formed by a seventh lighting mode in which the second and third semiconductor light emitting element chips 43*b* and 43*c* are turned on. In this light distribution pattern, the central area and the right-side area in the H-V area are illuminated with high-beam light. Each of the second and third semiconductor light emitting element chips 43*b* and 43*c* is disposed adjacent to the focal point F of the reflection surface 45*a* of the reflector 45. However, since light is distributed so that the illuminated areas PA2 and PA3 are next to each other, no clear area HCA is formed.

Figure 4:
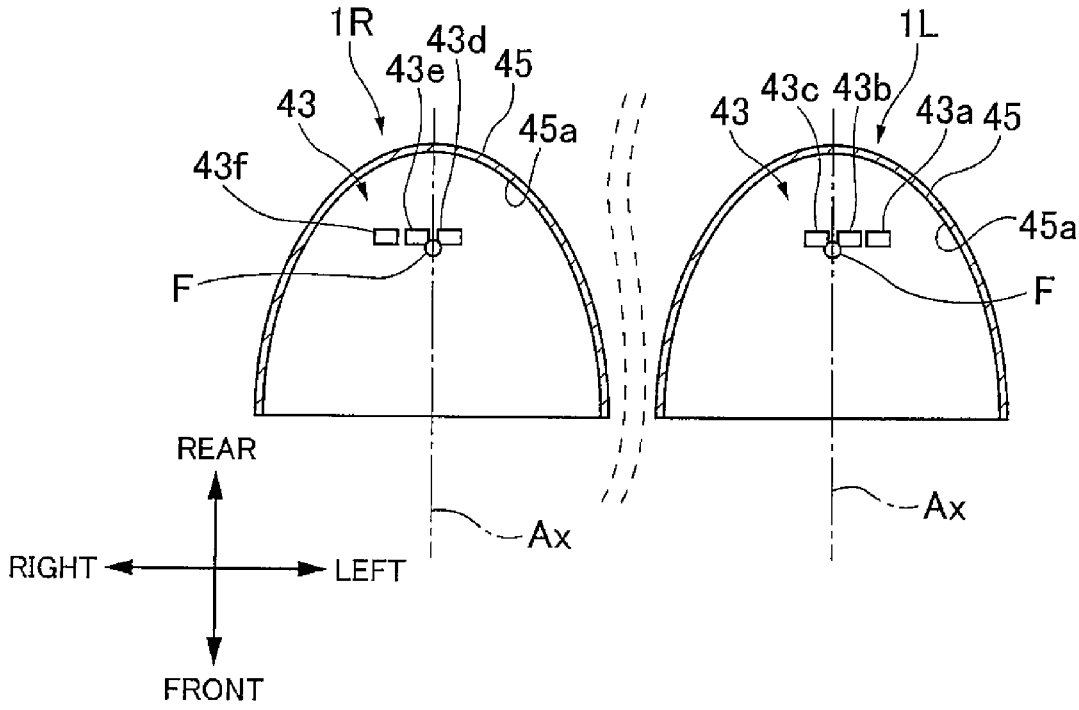
FIG. 4 is a schematic diagram showing a positional relationship between the semiconductor light emitting element chips and the focal point of a reflection surface of a reflector in each of left and right vehicular headlamps.

Next, the light distribution patterns formed when both the left and right vehicular headlamps 1L and 1R are employed will be described with reference to FIGS. 4 and 5. FIG. 4 is a schematic diagram showing a positional relationship between the semiconductor light emitting element chips 43 and the focal point F of the reflection surface 45*a* of the reflector 45 in each of the left and right vehicular headlamps 1L and 1R.

FIGS. 5A to 5H are diagrams showing light distribution patterns formed when both the left and right vehicular headlamps 1L and 1R are employed. Furthermore, FIGS. 5A to 5H show light distribution patterns projected on an imaginary vertical screen disposed at 25 meters in front of the vehicular headlamps 1L and 1R as in FIG. 3. In FIGS. 5A to 5H, the light distribution patterns shown on the left side are the light distribution patterns formed by high-beam light from the vehicle right-side vehicular headlamp 1R, and the light distribution patterns shown in the middle are the light distribution patterns formed by high-beam light from the vehicle left-side vehicular headlamp 1L, and the light distribution patterns shown on the right side are the light distribution patterns formed by the combination of high-beam light from the left vehicular headlamp 1L and high-beam light from the right vehicular headlamp 1R.

Furthermore, a character sequence "PA4" denotes an illuminated area that is illuminated by a fourth semiconductor light emitting element chip 43*d*, and a character sequence "HS4" denotes an imaginary smallest image of the fourth semiconductor light emitting element chip 43*d* in the illuminated area PA4, and a character sequence "HM4" denotes an imaginary largest image thereof in the illuminated area PA4. Furthermore, a character sequence "PA5" denotes an illuminated area that is illuminated by a fifth semiconductor light emitting element chip 43*e*, and a character sequence "HS5" denotes an imaginary smallest image of the fifth semiconductor light emitting element chip 43*e* in the illuminated area PA5, and a character sequence "HM5" denotes an imaginary largest image thereof in the illuminated area PA5. Furthermore, a character sequence "PA6" denotes an illuminated area that is illuminated by a sixth semiconductor light emitting element chip 43*f*, and a character sequence "HS6" denotes an imaginary smallest image of the sixth semiconductor light emitting element chip 43*f* in the illuminated area PA6, and a character sequence "HM6" denotes an imaginary largest image thereof in the illuminated area PA6.

In the vehicular headlamp 1L mounted at the left side of a front portion of a vehicle (hereinafter, referred to also as the left headlamp), as described above, the focal point F of the reflection surface 45*a* of the reflector 45 is disposed between the second and third semiconductor light emitting element chips 43*b* and 43*c* as shown in FIGS. 2 and 4. On the other hand, in the vehicular headlamp 1R mounted at the right side of the vehicle (hereinafter, referred to also as the right headlamp), the semiconductor light emitting element chips 43 aligned in a row in the vehicle lateral direction are named, in order from the left, as a fourth semiconductor light emitting element chip 43*d*, a fifth semiconductor light emitting element chip 43*e*, and a sixth semiconductor light emitting element chip 43*f*. The focal point F of the reflection surface 45*a* of the reflector 45 is disposed between the fourth and fifth semiconductor light emitting element chips 43*d* and 43*e*. That is, the left headlamp 1L and the right headlamp 1R are constructed so that the positional relationship between the semiconductor light emitting element chips 43 and the focal point F of the reflection surface 45*a* of the reflector 45 in one of the two headlamps 1L and 1R is symmetric to the positional relationship between the semiconductor light emitting element chips 43 and the focal point F of the reflection surface 45*a* of the reflector 45 in the other headlamp.

In this embodiment, eight high-beam light distribution patterns shown in FIGS. 5A to 5H can be formed by using both the left and right vehicular headlamps 1L and 1R constructed as described above.

Figure 5A:
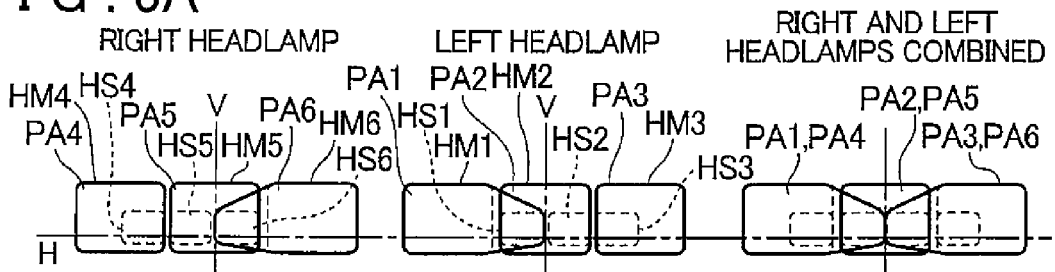
FIGS. 5A to 5H are schematic diagrams showing light distribution patterns obtained when both the left and right vehicular headlamps are employed.

FIG. 5A shows an ordinary high-beam light distribution pattern. In this light distribution pattern, the entire H-V area is illuminated with high-beam light, so that a maximum front field of view can be secured for a driver. For this light distribution pattern, all of the first to sixth semiconductor light emitting element chips 43*a*, 43*b*, 43*c*, 43*d*, 43*e*, and 43*f* of the left headlamp 1L and the right headlamp 1R are turned on by the control portion 50.

Figure 5B:
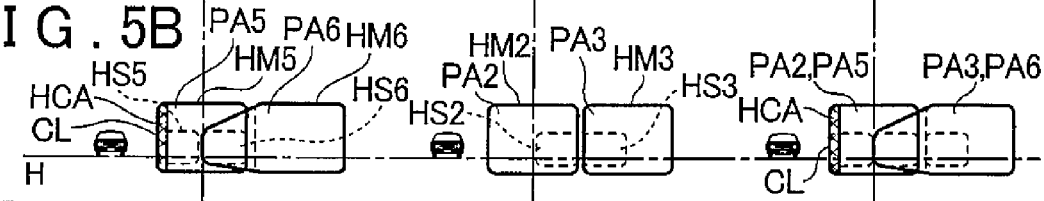

FIG. 5B shows a high-beam light distribution pattern that illuminates a front space and a right-side space. In this light distribution pattern, the central area and the right-side area in the H-V area are illuminated with high-beam light. This light distribution pattern is suitable for, for example, the case where neither an oncoming vehicle nor a pedestrian is present on the opposing lane side and a preceding vehicle or a pedestrian is present at the outer side on the host vehicle's lane side. In this light distribution pattern, good front visibility is secured for a driver, and glare is not given to an oncoming vehicle or a pedestrian on the opposing lane side.

In this light distribution pattern, the fifth and sixth semiconductor light emitting element chips 43*e* and 43*f* of the right headlamp 1R and the second and third semiconductor light emitting element chips 43*b* and 43*c* of the left headlamp 1L are turned on by the control portion 50. At this time, as for the right headlamp 1R, the clear area HCA at the left edge of the illuminated area PA5 that is illuminated by the fifth semiconductor light emitting element chip 43*e* forms a cut-off line CL because the focal point F of the reflection surface 45*a* of the reflector 45 is positioned between the fourth and fifth semiconductor light emitting element chips 43*d* and 43*e*.

Therefore, in this light distribution combination, the clear area HCA in the left edge portion of the illuminated area PA5 in the combined illuminated area forms a boundary with the non-illuminated area, and forms a cut-off line.

Figure 5C:
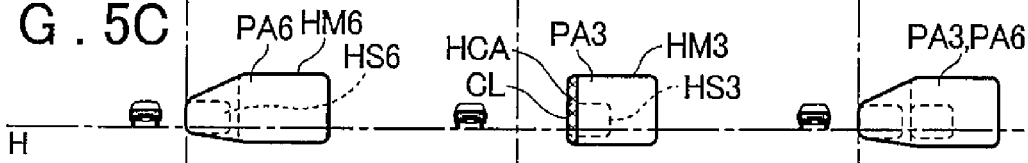

FIG. 5C shows a right-side high-beam light distribution pattern. In this light distribution pattern, a right-side area in the H-V area is illuminated with high-beam light. This light distribution pattern is suitable for, for example, the case where neither an oncoming vehicle nor a pedestrian is present on the opposing lane side and a preceding vehicle or a pedestrian is present between a space in the front of the host vehicle and the outer side on the host vehicle's lane side, more concretely, present approximately at the width of a vehicle left from the V axis.

For this light distribution pattern, the sixth semiconductor light emitting element chip 43*f* of the right headlamp 1R and the third semiconductor light emitting element chip 43*c* of the left headlamp 1L are turned on by the control portion 50. In the light distribution combination of the illuminated area PA6 of the right headlamp 1R and the illuminated area PA3 of the left headlamp 1L, since the illuminated area PA6 has a generally trapezoidal shape that extends in the lateral direction, the clear area HCA in the illuminated area PA3 overlaps with a central portion of the illuminated area PA6, and therefore is not positioned at the boundary with the non-illuminated area, and does not form a cut-off line CL.

Figure 5D:
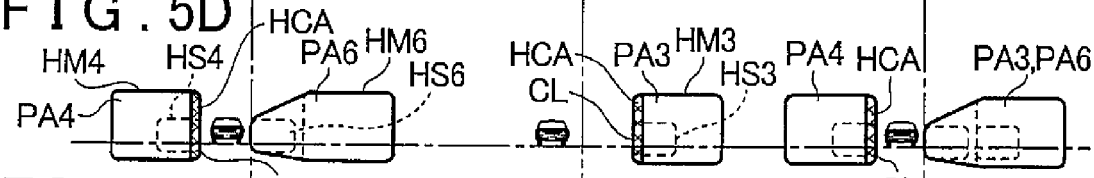

FIG. 5D shows a high-beam light distribution pattern that illuminates left and right-side spaces but does not illuminate a space in front of the vehicle. In this light distribution pattern, the left and right-side areas in the H-V area, excluding a central area, are illuminated with high-beam light. This light distribution pattern is suitable for, for example, the case where neither an oncoming vehicle nor a pedestrian is present on the opposing lane side and a preceding vehicle or a pedestrian is present on the left side of a space in front of the host vehicle on the host vehicle's lane side, more concretely, present at a position adjacent to the V axis and on the left side of the V axis.

For this light distribution pattern, the fourth and sixth semiconductor light emitting element chips 43*d* and 43*f* of the right headlamp 1R and the third semiconductor light emitting element chip 43*c* of the left headlamp 1L are turned on by the control portion 50. In the light distribution combination of the illuminated area PA6 of the right headlamp 1R and the illuminated area PA3 of the left headlamp 1L, the clear area HCA in the illuminated area PA3 does not form a cut-off line CL, as mentioned above. On the other hand, in a left-side area of the combined illuminated area, that is, in the illuminated area PA4, the clear area HCA at the right edge forms a boundary with a non-illuminated area, and forms a cut-off line CL.

Figure 5E:
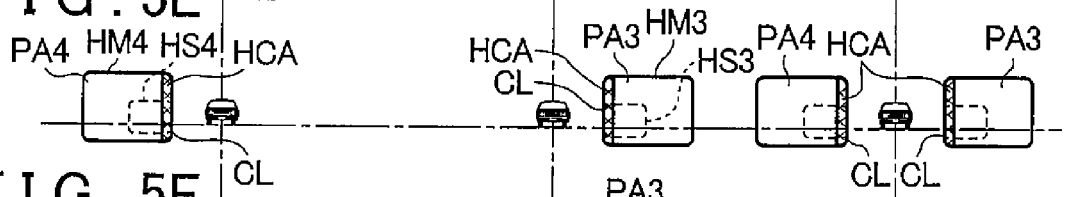

FIG. 5E shows a high-beam light distribution pattern that illuminates left and right-side spaces but does not illuminate a space in front of the vehicle. In this light distribution pattern, the left and right side areas in the H-V area, excluding a central area, are illuminated with high-beam light. This light distribution pattern is suitable for, for example, the case where neither an oncoming vehicle nor a pedestrian is present on the opposing lane side and a preceding, a pedestrian or the like is present in a space in front of the host vehicle in the host vehicle's lane side, more concretely, present in a space that overlaps with the V axis.

For this light distribution pattern, the fourth semiconductor light emitting element chip 43*d* of the right headlamp 1R and the third semiconductor light emitting element chip 43*c* of the left headlamp 1L are turned on by the control portion 50. At this time, as for the right headlamp 1R, a right-side edge portion of the illuminated area PA4 illuminated by the fourth semiconductor light emitting element chip 43*d* forms a clear area HCA because the focal point F of the reflection surface 45*a* of the reflector 45 is positioned between the fourth and fifth semiconductor light emitting element chips 43*d* and 43*e*. Furthermore, as for the left headlamp 1L, since the focal point F of the reflection surface 45*a* of the reflector 45 is positioned between the second and third semiconductor light emitting element chips 43*b* and 43*c*, a left-side edge area of the illuminated area PA3 illuminated by the third semiconductor light emitting element chip 43*c* forms a clear area HCA.

In this combined light distribution, the clear area HCA at the right-side edge of the illuminated area PA4, which is a left-side area in the combined illuminated areas, and the clear area HCA at the left side edge of the illuminated area PA3, which is a right-side area in the combined illuminated areas, form boundaries with the non-illuminated area, and form cut-off lines CL.

Figure 5F:
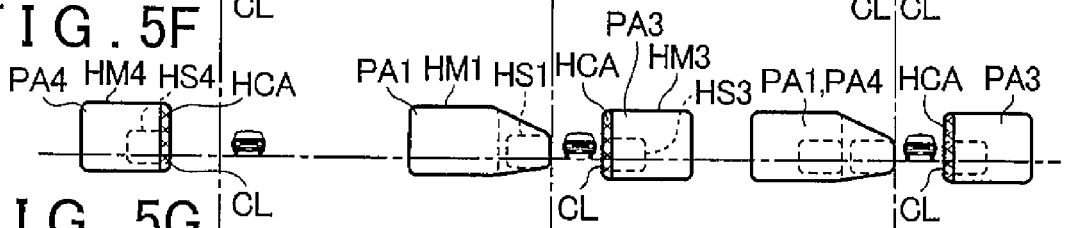

FIG. 5F shows a high-beam light distribution pattern that illuminates left and right-side spaces but does not illuminate a space in front of the vehicle. In this light distribution pattern, left and right-side areas in the H-V area, excluding a central area, are illuminated with high-beam light. This light distribution pattern is suitable for, for example, the case where neither a preceding vehicle nor a pedestrian is present on the host vehicle's lane side and an oncoming vehicle or a pedestrian is present on the opposing lane side, concretely, on the right side of the space in front of the host vehicle and, more concretely, at a position that is adjacent to the V axis and on the right side of the V axis.

For this light distribution pattern, the fourth semiconductor light emitting element chip 43*d* of the right headlamp 1R and the first and third semiconductor light emitting element chips 43*a* and 43*c* of the left headlamp 1L are turned on by the control portion 50. In the light distribution combination of the illuminated area PA4 of the right headlamp 1R and the illuminated area PA1 of the left headlamp 1L, since the illuminated area PA1 has a generally trapezoidal shape that extends in the lateral direction, the clear area HCA of the illuminated area PA4 overlaps with a central portion of the illuminated area PAT, and therefore is not positioned at a boundary with the non-illuminated area, and does not form a cut-off line CL.

On other hand, as for the right-side area of the illuminated areas resultant from the combination, that is, as for the illuminated area PA3, a clear area HCA at the left side edge forms a boundary with the non-illuminated area, and forms a cut-off line CL.

Figure 5G:
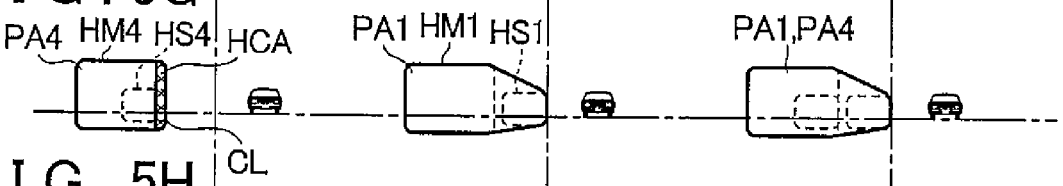

FIG. 5G shows a left-side high-beam light distribution pattern. In this light distribution pattern, a left-side area in the H-V area is illuminated with high-beam light. This light distribution pattern is suitable for, for example, the case where neither a preceding vehicle nor a pedestrian is present on the host vehicle's lane side and an oncoming vehicle or a pedestrian is present on the opposing lane side, concretely, between the outer side thereof and a space in front of the host vehicle and, more concretely, at a position of approximately the width of a vehicle right from the V axis.

For this light distribution pattern, the fourth semiconductor light emitting element chip 43*d* of the right headlamp 1R and the first semiconductor light emitting element chip 43*a* of the left headlamp 1L are turned on by the control portion 50. In the light distribution combination of the illuminated area PA4 of the right headlamp 1R and the illuminated area PA1 of the left headlamp 1L, since the illuminated area PA1 has a generally trapezoidal shape that extends in the lateral direction, the clear area HCA of the illuminated area PA4 overlaps with a central portion of the illuminated area PA1, and therefore is not positioned at a boundary with the non-illuminated area, and does not form a cut-off line CL.

Figure 5H:
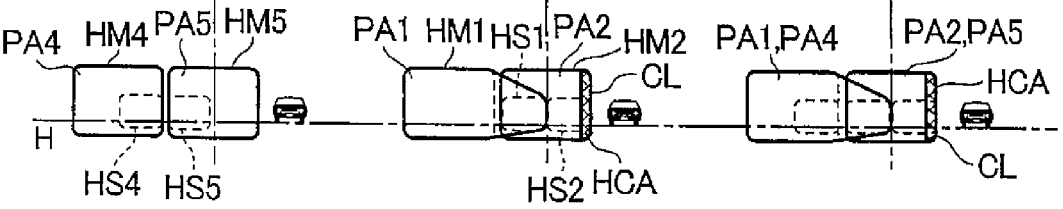

FIG. 5H shows a high-beam light distribution pattern that illustrates a front space and a left-side space. In this light distribution pattern, the central area and the left-side area in the H-V area are illuminated with high-beam light. This light distribution pattern is suitable for, for example, the case where neither a preceding vehicle nor a pedestrian is present on the host vehicle's lane side and an oncoming vehicle or a pedestrian is present at an outer side on the opposing lane side.

For this light distribution pattern, the fourth and fifth semiconductor light emitting element chips 43*d* and 43*e* of the right headlamp 1R and the first and second semiconductor light emitting element chips 43*a* and 43*b* of the left headlamp 1L are turned on by the control portion 50. In this light distribution combination, the clear area HCA at the right-side edge of the illuminated area PA2 in the illuminated areas resultant from the combination forms a boundary with the non-illuminated area, and forms a cut-off line CL.

Thus, by using both the left and right vehicular headlamps 1L and 1R, the eight high-beam light distribution patterns shown in FIGS. 5A to 5H can be formed. Therefore, for example, when a vehicle in front of the host vehicle enters a curve and moves from the position shown in FIG. 5B to the position shown in FIG. 5H (i.e., from the left side to the right side in FIGS. 5A to 5H), the position at which the cut-off line CL is formed can be successively changed by changing the light distribution pattern in order from the light distribution pattern shown in FIG. 5B to the light distribution pattern shown in FIG. 5H according to change in the position of the vehicle present in front of the host vehicle. Thus, it is possible to realize a fine control of the light distribution pattern so that glare is not given to an oncoming vehicle or a pedestrian on the opposing lane side while front visibility for the driver is secured.

As described above, according to the vehicular headlamp 1L (1R) of this embodiment, the plurality of semiconductor light emitting element chips 43 are disposed along the lateral direction of the vehicle, and the focal point F of the reflection surface 45*a* of the reflector 45 is disposed between the semiconductor light emitting element chips 43*b* and 43*c* (43*d* and 43*e*) that are next to each other, so that an end portion of each of the illuminated areas PA2 and PA3 (PA4 and PA5) that are illuminated areas in front of the vehicle forms a clear area HCA. By disposing the clear areas HCA of the illuminated areas PA2 and PA3 (PA4 and PA5) in end portions of the light distribution pattern, a cut-off line CL that is clear in contour and high in luminance can be formed. Furthermore, a natural distribution of luminous intensity in which luminous intensity gradually changes from the cut-off line CL can be obtained.

Furthermore, since the vehicular headlamp 1L (1R) of the embodiment has a structure that makes it possible to distribute light in front of the vehicle without a need to use a projection lens, it is possible to reduce the production cost. Furthermore, since the light from the semiconductor light emitting element chips 43 is entirely reflected forward by the reflector 45 without using a projection lens, the light utilization efficiency improves as well.

Furthermore, according to the vehicular headlamp 1L (1R) of the embodiment, the light emitting surface 44 of each of the semiconductor light emitting element chips 43 has a quadrilateral shape, and the semiconductor light emitting element chips 43 are disposed so that the one of the four sides of each quadrilateral light emitting surface 44 which is near the focal point F lies along the longitudinal direction of the vehicle. Therefore, according to the embodiment, the cut-off line CL can be formed more clearly in the up-down direction.

Furthermore, according to the vehicular headlamps 1L and 1R of the embodiment, the left headlamp 1L and the right headlamp 1R are constructed so that the positional relationship of the semiconductor light emitting element chips 43 and the focal point F of the reflection surface 45*a* of the reflector 45 in one of the two headlamps is symmetrical to the corresponding positional relationship in the other headlamp. Therefore, by controlling the left headlamp 1L and the right headlamp 1R in coordination via the control portion 50, control of the light distribution pattern that is precise and optimal in the disposal of the cut-off line or lines CL can be realized according to the traveling position of a preceding vehicle, an oncoming vehicle, etc.

Incidentally, the invention is not limited to what has been described as examples in conjunction with the foregoing embodiment, but can be appropriately modified within the scope of the invention. Although in the foregoing embodiment, the number of semiconductor light emitting element chips provided in each vehicular headlamp is three, the number of semiconductor light emitting element chips is not limited to this, but may also be other than three. Furthermore, although in the embodiment, the semiconductor light emitting element chips are arranged in a row, this arrangement is not restrictive. That is, semiconductor light emitting element chips may also be arranged in a plurality of rows, for example, two rows. Furthermore, although in the embodiment, the light emitting surface of each of the semiconductor light emitting element chips has a square shape, this is not restrictive. That is, the shape of the light emitting surface may also be a quadrilateral shape such as a rectangular shape or the like.

(US Only)

A light emitting surface of each of the semiconductor light emitting element chips may have a quadrilateral shape, and the semiconductor light emitting element chips may be disposed so that, of four sides of the quadrilateral light emitting surface of each semiconductor light emitting element chip, one side that is the closest to the focal point lies along the headlamp beam direction.

What is claimed is:

1. A vehicular headlamp comprising:

a plurality of semiconductor light emitting element chips; and a reflector that has a reflection surface with a paraboloid shape, and that reflects, by the reflection surface, light from the semiconductor light emitting element chips so as to send the light in a headlamp beam direction of the vehicular headlamp, wherein the plurality of semiconductor light emitting element chips are arranged along a plane perpendicular to the headlamp beam direction, and a focal point of the reflection surface of the reflector is disposed in or near an area between the semiconductor light emitting element chips that are next to each other.

2. The vehicular headlamp according to claim 1, wherein the focal point is disposed between the semiconductor light emitting element chips that are next to each other.

3. The vehicular headlamp according to claim 1, wherein the headlamp beam direction is a forward direction of a vehicle, on which the vehicular headlamp is mounted, and the plurality of semiconductor light emitting element chips are arranged along a lateral direction of the vehicle.

4. The vehicular headlamp according to claim 3, wherein a number of the semiconductor light emitting element chips is three, and the two semiconductor light emitting element chips adjacent to the area are the two light emitting element chips disposed on an inner side with respect to the vehicle in the lateral direction of the vehicle.

5. The vehicular headlamp according to claim 1, wherein a projection lens is absent on an optical path extending from the semiconductor light emitting element chips to a location where light goes out of the vehicular headlamp.

6. The vehicular headlamp according to claim 1, wherein the semiconductor light emitting element chips are capable of being turned on and off independently of each other.

7. The vehicular headlamp according to claim 1, wherein a light emitting surface of each of the semiconductor light emitting element chips has a quadrilateral shape.

8. The vehicular headlamp according to claim 7, wherein the semiconductor light emitting element chips are disposed so that, of four sides of the quadrilateral light emitting surface of each semiconductor light emitting element chip, one side that is the closest to the focal point lies along the headlamp beam direction.

9. The vehicular headlamp according to claim 8, wherein the semiconductor light emitting element chips are disposed so that the one side that is the closest to the focal point lies along a longitudinal direction of a vehicle, on which the vehicular headlamp is mounted.

10. The vehicular headlamp according to claim 1, wherein of the plurality of semiconductor light emitting element chips, at least the two semiconductor light emitting element chips adjacent to the area are each provided with a light emitting surface whose edge adjacent to the area is straight extending along the headlamp beam direction.

* * * * *